United States Patent [19]

Chandler

[11] 4,430,819

[45] Feb. 14, 1984

[54] DISPLAY SIGN ASSEMBLY

[76] Inventor: Vernon P. Chandler, 1403 Braewood, Duncanville, Tex. 75137

[21] Appl. No.: 320,419

[22] Filed: Nov. 12, 1981

[51] Int. Cl.[3] ..... G09F 13/04

[52] U.S. Cl. ..... 40/564; 40/156; 40/603

[58] Field of Search ..... 40/152, 156, 152.2, 40/564, 603; 160/371, 372, 374, 374.1

[56] References Cited

U.S. PATENT DOCUMENTS

| | | | |
|---|---|---|---|
| 2,533,566 | 12/1950 | Eichelman | 40/603 |
| 3,885,335 | 5/1975 | Egermayer | 40/603 |
| 3,922,806 | 12/1975 | Saad | 40/152 |
| 4,194,312 | 3/1980 | Connors et al. | 40/603 |
| 4,265,039 | 5/1981 | Brooks | 40/603 |
| 4,317,302 | 3/1982 | Von de Linde | 40/564 |

FOREIGN PATENT DOCUMENTS

| | | | |
|---|---|---|---|
| 1345707 | 11/1963 | France | 40/564 |

*Primary Examiner*—Gene Mancene
*Assistant Examiner*—Wenceslao J. Contreras
*Attorney, Agent, or Firm*—Hubbard, Thurman, Turner & Tucker

[57] ABSTRACT

A lighted display sign having a main frame or cabinet for supporting a light source and one or more sign faces characterized by a decorated sheet of flexible translucent material such as that manufactured under the trademark PANAFLEX. The sign face is mounted on a removable face frame comprising a perimeter member and a plurality of spaced apart brace members connected at their opposite ends to opposed longitudinal portions of the perimeter member. The brace members stand off from the plane of the sign face to eliminate perceived shadows on the sign face from the light source. The sign facing is attached to the perimeter frame by a plurality of spaced apart threaded fasteners which secure the facing material to a surface of the perimeter member which is opposed to and spaced from the front surface of the face frame coplanar with the decorated face. The facing material is suitably tensioned prior to installation of the tapping type fasteners by stretching the facing material over the frame and supporting the material in the stretched condition while the fasteners are installed.

11 Claims, 5 Drawing Figures

DISPLAY SIGN ASSEMBLY

BACKGROUND OF THE INVENTION

1. Field of the Invention

The present invention pertains to lighted and unlighted display signs having improved means for attaching a flexible sign face to a frame and further wherein the frame is particularly adapted for single and double faced backlighted signs.

2. Background Art

In the art of display sign structures, it is important to provide a structure which is economical and light in weight but is capable of withstanding environmental effects including relatively high wind loads. In order to minimize the supporting structure for various types of display signs, a number of improvements in sign structures have been developed, including the provision of lightweight flexible sign faces formed of translucent plastic. One type of signal face which has been commercially developed is manufactured under the trademark PANAFLEX. This type of sign facing requires a substantially rigid support frame to which the facing may be fastened and stretched relatively tight to maintain proper face tension.

The conventional manner of mounting flexible translucent sign faces such as the PANAFLEX brand, requires a relatively complicated clamping arrangement for securing the perimeter of the face to the sign frame or body and for adjusting the tension in the face at installation. In order to improve the appearance of display signs using the PANAFLEX brand facing and standard mounting structure, additional relatively complicated framing is required to support and also conceal the face mounting structure. Moreover, the type of structure heretofore provided for mounting the PANAFLEX type flexible sign facing also requires additional space when retrofitted to existing sign cabinets and does not lend itself to sign structures which are easy to assemble initially and are readily serviceable for changing lighting or performing other service operations.

It has become highly desired to provide simpler mounting structure for flexible sign facing, particularly for backlighted signs wherein the facing support structure should be relatively uncomplicated, compact, and lightweight without sacrificing strength and the ability to withstand high wind loads. The present invention provides these desiderata and also provides an improved sign frame which is adapted for improved backlighting of single or multi-faced signs using translucent flexible sign facing.

SUMMARY OF THE INVENTION

The present invention provides an improved mounting arrangement for flexible sign facing which is structurally simple and provides for suitable tensioning of the sign facing without requiring as much space and numbers of components as required by prior art sign structures.

The present invention is particularly adapted to provide an improved mounting frame arrangement for flexible plastic sign facing of the type manufactured and sold under the trademark PANAFLEX and similar types of sign facing wherein a relatively mechanically simple mounting frame is provided which, together with an improved technique for applying the facing to the frame, substantially reduces the cost and complexity of the sign structure.

In accordance with one aspect of the present invention, there is provided a support frame for flexible sign facing comprising a lightweight aluminum tube of preferably square or rectangular cross-section to which the flexible facing is attached by spaced apart self-threading screws or the like which are threadedly engaged with the frame at suitable intervals along the frame, and which in conjunction with an improved assembly process, eliminates the need for complicated face tensioning structure.

Further in accordance with the present invention, there is provided an improved display sign having a simplified framing or retainer structure covering the mounting frame for the flexible facing material. The facing support frame, as well as the associated covering and retaining structure together with the main sign frame or cabinet, may be manufactured of standard structural metal shapes without requiring special extrusions and framing components for supporting the flexible facing and forming the support structure therefor.

In accordance with another aspect of the present invention, there is provided a sign support structure for backlighted translucent flexible facing which includes requisite mechanical strength for supporting the facing under required tension and wherein the location of light sources within the sign cabinet do not effect the lighting of the sign facing by producing shadows or uneven light distribution.

The present invention still further provides an improved sign support structure which is easily serviceable for changing lamps and for changing the sign facing itself without requiring complicated procedures for removing portions of the sign structure during exchange or replacement of the sign facing.

In accordance with yet another aspect of the present invention, there is provided an improved method of mounting a flexible sign facing or the like to a support frame therefor, which provides suitable tensioning of a flexible sign facing material without requiring complicated tensioning procedures and associated structure.

Those skilled in the art will recognize the superior features and advantages of the present invention upon reading the detailed description which follows in conjunction with the drawings.

DESCRIPTION OF THE PREFERRED EMBODIMENTS

Figure 1:
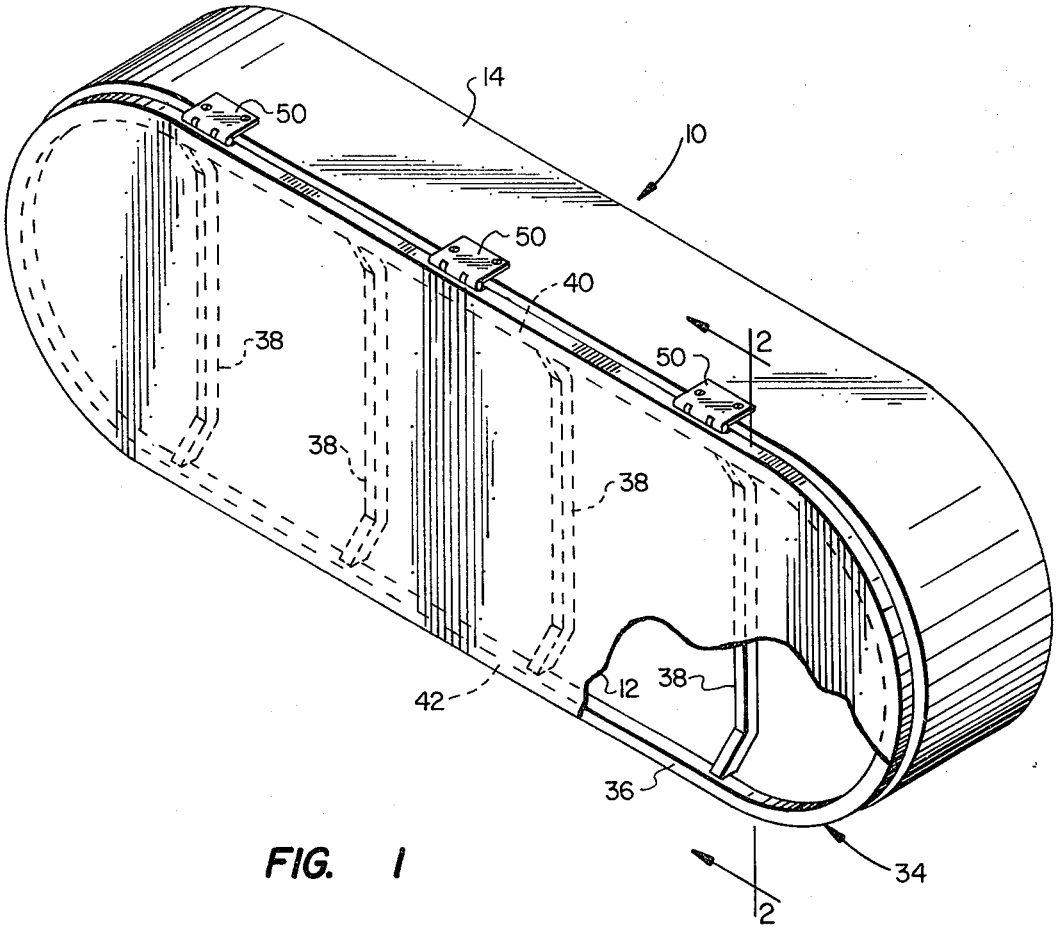
FIG. 1 is a perspective view of a single faced interior lighted display sign in accordance with the present invention.

In the description which follows and in the drawings, like parts are identified with the same reference numerals, respectively.

Referring to FIG. 1 of the drawings, there is illustrated a display sign of the type which may be used, for example, to identify a retail store location or the like. The exemplary sign, generally designated by the numeral 10, is of the type which may be mounted on a vertical wall or other support structure, not shown, and may be connected to suitable electrical conductors to provide illumination from a source within the interior of the sign structure which may include a plurality of lamps arranged to provide suitable lighting without shadows or "hot" spots visible on the sign face 12.

The sign face 12 is preferably of a flexible plastic sheet which is translucent and which is printed with suitable indicia so that when the light source is placed behind the face an attractive lighted display is provided. The flexible sign facing, one type of which is manufactured under the trademark PANAFLEX by 3M Corporation, Minneapolis, Minn., is of a suitable material which may be stretched on a support structure and mounted on a cabinet which contains the light sources.

Figure 2:
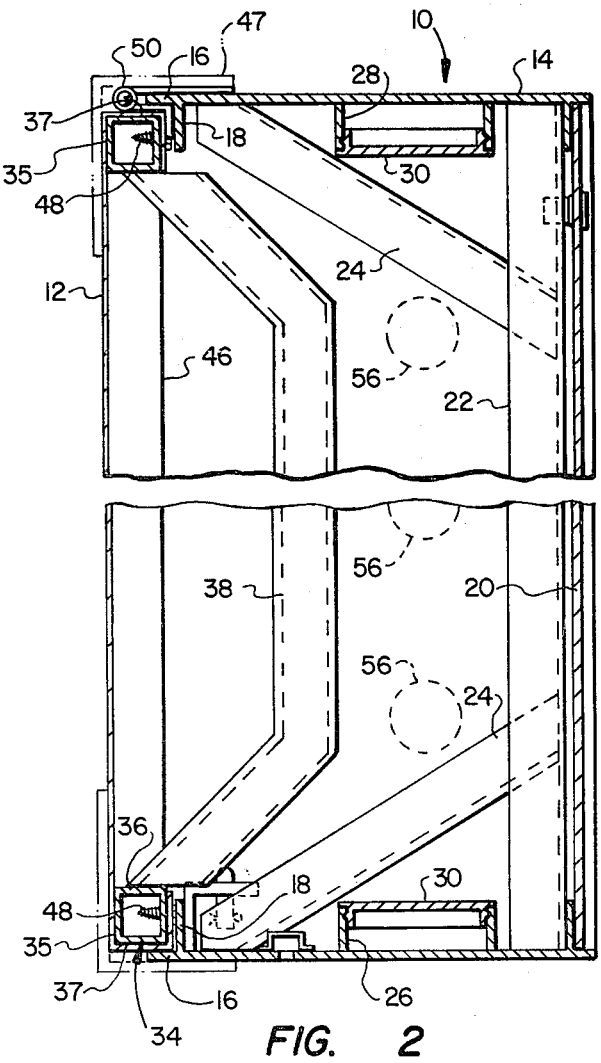
FIG. 2 is a transverse section view taken substantially along the line 2—2 of FIG. 1.

In accordance with the teaching of the present invention, the support structure for the face 12 is of an improved design which is more easily fabricated, requires less space than prior art supporting structure, may be retrofitted to existing sign cabinetry, and may provide for a lighter weight and more economically fabricated sign. Referring also to FIG. 2, the improved display sign of the present invention includes a main cabinet or frame 14 which may be formed of a suitable extruded aluminum structural shape as indicated, or may be made up of conventional aluminum or other metal shapes fabricated into a frame assembly. The frame 14 includes a front outwardly projecting peripheral flange 16 and an inwardly extending peripheral flange 18 which extends around the perimeter of the frame. The backface of the frame 14 may comprise a relatively large plate member 20 and a suitable number of spaced apart column members 22, one shown in FIG. 2, which may be formed of aluminum angle or T-section, for example. The column members 22 are preferably braced by members 24 having a similar cross-sectional shape. The frame member 14 may include integrally formed wall portions 26 and 28, as shown in FIG. 2, forming together with a cover 30 enclosures for electrical wiring and lamp sockets or the like, not shown. Although the sign 10 is shown as having oval ends, the frame 14 may be rectangular or other shapes and the configuration of the frame 14 at the end portions may be same or of a similar shape as that illustrated by the cross-sectional views of FIGS. 2 and 3.

In accordance with the present invention, the flexible facing 12 of the sign 10 is mounted on a face or subframe generally designated by the numeral 34. The frame 34 is preferably fabricated of, for example, aluminum tubing of square or rectangular cross-sectional shape and formed in the general shape of the outline of the sign 10 as indicated. The face frame 34 includes the perimeter member 36, as well as a plurality of intermediate somewhat C-shaped brace members 38 suitably spaced apart and interconnecting the upper and lower longitudinal frame portions 40 and 42, FIG. 1, to provide a substantially rigid but lightweight frame structure which satisfies additional requirements in accordance with backlighted sign structures as will be explained further herein.

Although the face 12 is required to be stretched relatively tight on the face frame 34, sufficient structural integrity may be obtained, for example, with a frame approximately 21 feet long by 7 feet wide using one inch square aluminum tubing meeting ASTM Specification 6063-T5. The C-shaped brace members 38 may also be of one inch square aluminum tubing or larger, and as illustrated for a sign according to the aforementioned dimensions, a total of four equally spaced apart brace members are suitable.

Contrary to the requirements believed heretofore necessary for properly mounting and tensioning the face 12, in accordance with the present invention, the face may be stretched over supporting surfaces 35 and 37 of the frame member 36 and suitably fastened to its backside surface 46, FIG. 2, by spaced apart fasteners 48 which may be, for example, preferably of the hexagon washer head tapping screw type. The face 12 is preferably aligned on the frame member 36 and fastened along the backside of one longitudinal portion 40, or 42 and then stretched around the opposite longitudinal portion by a suitably modified gripping tool which, for example, could comprise a pair of locking pliers having modified jaws of suitable width to prevent tearing the face material during the tensioning operation. As the material is stretched around the opposite frame member portion and held by a suitable number of the aforementioned modified pliers, the tapping screws 48 are applied at suitably spaced intervals to secure the facing 12 to the frame member 36. This method has been suitably developed and eliminates the rather complex structure which is used in conventional mountings of flexible plastic sign facings of the type referred to herein.

As illustrated in FIG. 2, the face frame 34 is preferably mounted within the periphery of the flange 16 and is, of course, suitably dimensioned to be a relatively close fit within the perimeter of the flange. The face frame 34 is preferably provided with a number of spaced apart lightweight open hinges 50 secured to the face frame 34 and to the main frame 14 using suitable threaded fasteners. As illustrated in the drawing FIG. 2, the face 12 is provided of sufficient peripheral dimension to be stretched over three adjacent sides of the frame member 36 to provide suitable support for the face material. Although fastening to the backside 46 of the frame member 36 is preferred, as illustrated, it is also possible to consider the arrangement whereby the fasteners would be connected to the outer peripheral edge of the frame member 36 or even the front face although these arrangements may be less suitable than that which is illustrated. With the simplified framing and support structure for the face 12 in accordance with the present invention, the peripheral retainer or shield may also be eliminated or, if it is desired to maximize the aesthetic effect of the sign, a peripheral L-shaped face retainer member may be fastened over the face frame 34 and to the main frame 14, if desired. In FIG. 2, such a retainer member is illustrated with phantom lines and designated by the numeral 47.

Referring to FIGS. 1 and 2, the improved sign structure of the present invention is further characterized in that the perimeter frame member 36 of the face frame 34 is braced by the plurality of spaced apart C-shaped brace members 38 which are preferably welded at their opposite ends, respectively, to the opposed longitudinal portions 40 and 42 of the perimeter member. The brace members 38 are configured such that a major portion of each of the members stands off from the plane of the face 12 sufficiently to eliminate any perceived shadow from a light source disposed behind the brace members with respect to the face 12. The brace members 38 may be formed of suitable metal structural shapes and are preferably fabricated of square cross-section aluminum tubing of the same size used for the frame member 36.

Figure 3:
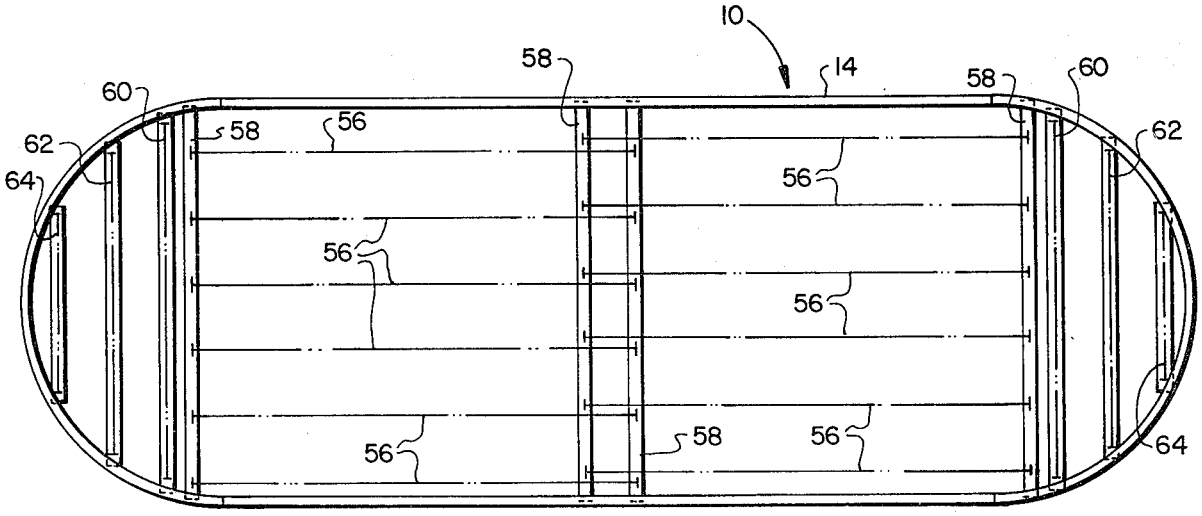
FIG. 3 is a front elevation of the sign illustrated in FIGS. 1 and 2 and showing in somewhat diagrammatic form the location of the lamps for lighting the sign facing.

Referring particularly to FIG. 3, there is illustrated somewhat schematically the placement of the light source for backlighting the face 12. The light source for the sign 10 is characterized by a plurality of elongated lamps 56 which may be of the fluorescent tube type and which are disposed in an array of parallel side-by-side tubes running longitudinally and supported at their opposite ends within the frame 14 by suitable socket assemblies 58. The lamps 56 are arranged in somewhat overlapping relationship near the center of the sign face to provide sufficient illumination for the center of the sign. The opposed curved ends of the exemplary sign 10 are also provided with generally parallel spaced apart lamps 60, 62 and 64, as illustrated, which are suitably supported by socket assemblies mounted on the main frame 14. The lamps 56 are spaced between the backwall 20 of the frame 14 and the brace members 38, thereby placing the light source for the face 12 such that the brace members are disposed between the light source and the sign face. However, by providing the brace members 38 configured such that they stand off substantially from the plane of the sign face 12, there is virtually no perceived shadow on the face.

Those skilled in the art of display signs will appreciate that the arrangement of the perimeter face frame 34 and the bracing therefor, together with the improved means for mounting the flexible face sheet represents a substantial improvement in lighted display sign structures. The construction of the face frame 34 and the method of fastening the flexible sheet facing to the frame, considerably reduces the cost of fabricating relatively large display signs of various types. The weight of the sign is reduced, thereby simplifying the sign mounting structure and the space required for the sign face itself is also less than prior art arrangements for supporting flexible sheet facing material.

Figure 4:
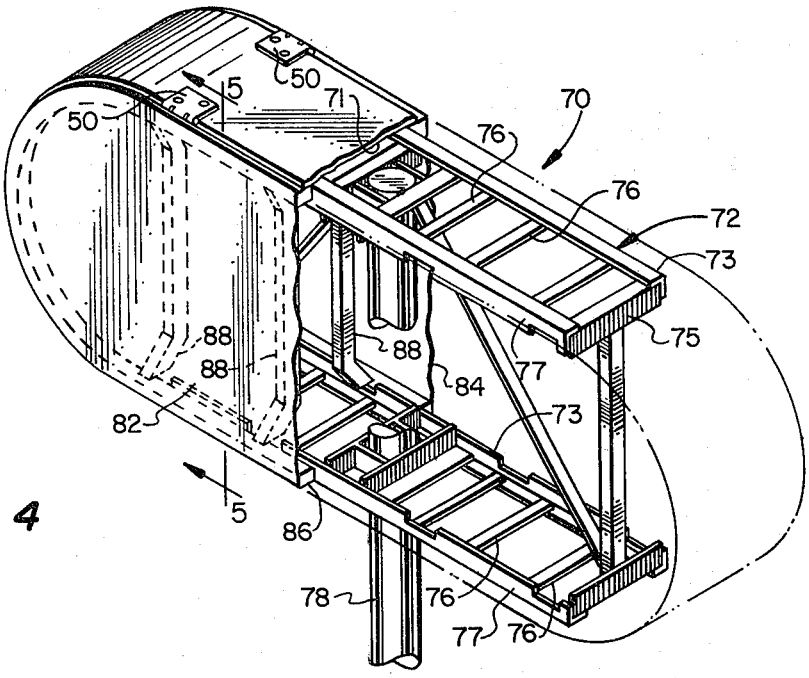
FIG. 4 is a perspective view of a double faced backlighted sign in accordance with the present invention.
Figure 5:
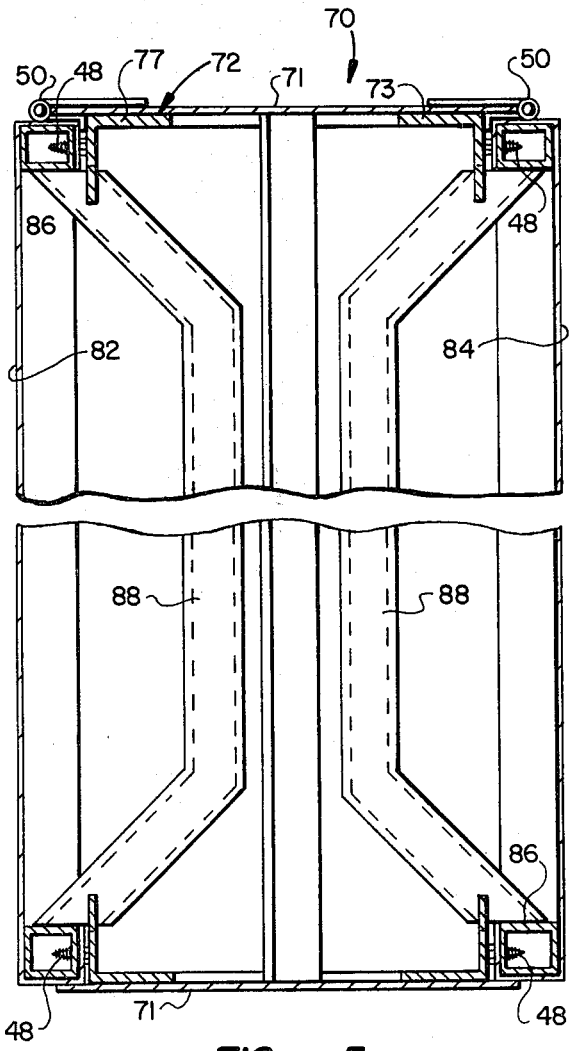
FIG. 5 is a transverse section view taken along the line 6—6 of FIG. 5.

Display signs following the teaching of the present invention may take various forms and shapes without departing from the scope and spirit of the inventive concept. Referring to FIG. 4, an alternate embodiment of the present invention is illustrated and comprises a double faced sign generally designated by the numeral 70. The sign 70 includes a main frame 72 formed of conventional steel or aluminum angle sections 73, 75 and 77 suitably welded together and braced by a plurality of transverse flat members 76. The frame 72 is adapted to be mounted on a vertical standard 78. A sheet or extruded metal filler member 71 forms an enclosure for the frame 72 and the opposite end portions of the sign 70. A plurality of generally vertically disposed lamps, not shown, may be positioned within the frame 72 for illuminating opposed sign faces generally designated by the numerals 82 and 84. Each of the sign faces 82 and 84 includes a frame comprising a perimeter member 86 and a plurality of spaced apart brace members 88 extending between the longitudinal portions of the perimeter member and standing off from the plane of the faces of the sign in a manner similar to the braces 38 for the frame member 36. The aforementioned array of lamps is disposed between the sets of braces for each of the faces 82 and 84 and provides sufficient illumination of the inner side of the sheets of flexible material comprising the faces such that the faces are illuminated without any shadows occurring thereon from the brace members. In the embodiment of FIGS. 4 and 5, the flexible facing sheets for each of the faces 82 and 84 are secured to the perimeter members in the same manner as the embodiment of FIG. 1. Moreover, the faces may also be provided with a retainer or trim flange, not shown, disposed around the periphery of the faces in the same manner as the embodiment disclosed in FIGS. 1 through 3.

Those skilled in the art will also appreciate that the improved sign face arrangement according to the present invention may be retrofitted to existing sign frames and cabinet structures. Since the perimeter member and the bracing therefor comprising the face frame may be easily fabricated in a variety of shapes and since the fastening of the flexible sheet facing material to the face frame according to the present invention is greatly simplified, sign faces of a wide variety of shapes and sizes may be provided in accordance with the teaching of the present invention. Although specific embodiments of the invention are disclosed herein, those skilled in the art will recognize that various substitutions and modifications may be made without departing from the scope and spirit of the appended claims.

What is claimed is:

1. A lighted display sign having a decorated face formed on a surface of a sheet of relatively thin flexible light transmitting material, said sign including a main frame, a face frame mounted on said main frame and characterized by a perimeter member including a first surface thereon to which said sheet is fastened in a pretensioned condition by a plurality of spaced apart fasteners such that said decorated surface of said face extends across a space delimited by said perimeter member, a plurality of brace members spanning said space delimited by said perimeter member and connected at their opposite ends to said perimeter member, said brace members being shaped such that major portions of said brace members stand off from the plane of said decorated face sufficiently to eliminate perceived shadow from a light source disposed on said main frame in a position such that said brace members are between said light source and said face.

2. The sign set forth in claim 1 wherein:

said perimeter member is braced solely by said brace members across the space delimited by said perimeter member.

3. The sign set forth in claim 1 wherein:

said perimeter member comprises a rectangular cross-section tubular member, and said sheet is folded over and contiguous with three surfaces of said tubular member and is fastened in a pretensioned condition to a surface of said tubular member spaced from and substantially parallel to a surface of said tubular member which is coplanar with said sheet.

4. A display sign having a sign face comprising a sheet of relatively thin flexible material having a surface with visible indicia and adapted to be mounted on a frame under tension; said sign including a main frame, and a face frame removably supported on said main frame, said face frame comprising a continuous perimeter member for supporting said sheet across a space delimited by opposed portions of said perimeter member, said perimeter member comprising a tubular member of substantially rectangular cross-section including a first surface for supporting said sheet substantially coplanar with said surface with visible indicia, a second surface supporting said sheet and not coplanar with said first surface, a plurality of spaced apart tapping type threaded fasteners engaged with said perimeter member for fastening said sheet to said second surface under a preselected tension; means for detachably securing said perimeter member to said main frame, and at least one brace member connected to opposed longitudinal portions of said perimeter member at opposite ends of said brace member, respectively, said brace member spanning said space delimited by said perimeter member in such a way that a major portion of said brace member stands off from the plane of said sheet to minimize perceived shadow on the surface of said face.

5. The sign set forth in claim 4 wherein:

said sheet is supported by a third surface between said first and second surfaces.

6. The sign set forth in claim 4 wherein:

said sign includes a plurality of brace members disposed side-by-side in spaced apart generally parallel relationship to said one brace member and extending, respectively, between opposed longitudinal portions of said perimeter member.

7. The sign set forth in claim 4 wherein:

said material forming said sheet is translucent and said sign includes a light source disposed on said main frame and spaced from said sheet such that said brace members are between said sheet and said light source

8. The sign set forth in claim 7 wherein:

said sign includes a second face frame spaced from said first face frame and including a sign face formed by a second sheet of flexible translucent material mounted on said second face frame, and said light source is disposed between said sign faces.

9. The sign set forth in claim 4 wherein:

said face frame is hinged to said main frame along a longitudinal portion of said perimeter member.

10. The sign set forth in claim 4 wherein:

said main frame includes a recess for receiving said perimeter member in supporting relationship formed by a pair of flanges extending at an angle with respect to each other around said perimeter member.

11. The sign set forth in claim 4 together with:

a retainer cap disposed around said perimeter member and contiguous with a portion of said sheet extending across said one surface of said perimeter member.

* * * * *